US010988712B1

(12) United States Patent
Regalado, Sr.

(10) Patent No.: US 10,988,712 B1
(45) Date of Patent: Apr. 27, 2021

(54) WATER MINERAL CLEANING SOLUTIONS AND RELATED METHODS

(71) Applicant: Miguel Angel Regalado, Sr., Cathedral City, CA (US)

(72) Inventor: Miguel Angel Regalado, Sr., Cathedral City, CA (US)

( * ) Notice: Subject to any disclaimer, the term of this patent is extended or adjusted under 35 U.S.C. 154(b) by 0 days.

(21) Appl. No.: 16/870,718

(22) Filed: May 8, 2020

Related U.S. Application Data

(63) Continuation-in-part of application No. 16/000,106, filed on Jun. 5, 2018, now Pat. No. 10,683,468.

(60) Provisional application No. 62/515,167, filed on Jun. 5, 2017.

(51) Int. Cl.

| | |
|---|---|
| ***C11D 3/04*** | (2006.01) |
| ***C11D 7/10*** | (2006.01) |
| ***C11D 7/08*** | (2006.01) |
| ***C11D 3/37*** | (2006.01) |
| ***C11D 1/14*** | (2006.01) |
| ***C11D 3/20*** | (2006.01) |
| ***C11D 3/32*** | (2006.01) |
| ***C11D 3/30*** | (2006.01) |
| ***C11D 3/22*** | (2006.01) |

(52) U.S. Cl.
CPC ..... *C11D 3/30* (2013.01); *C11D 1/146* (2013.01); *C11D 3/042* (2013.01); *C11D 3/048* (2013.01); *C11D 3/222* (2013.01); *C11D 3/323* (2013.01); *C11D 3/37* (2013.01)

(58) Field of Classification Search
None
See application file for complete search history.

(56) References Cited

U.S. PATENT DOCUMENTS

| | | | |
|---|---|---|---|
| 5,895,781 | A | 4/1999 | Neumiller et al. |
| 5,910,475 | A | 6/1999 | Neumiller et al. |
| 5,998,356 | A | 12/1999 | Alam et al. |
| 6,162,371 | A | 12/2000 | Rees |
| 6,465,412 | B1 | 10/2002 | Mahieu et al. |
| 6,551,985 | B1 | 4/2003 | Bianchetti et al. |
| 7,288,512 | B2 | 10/2007 | Boone et al. |
| 7,618,931 | B1 | 11/2009 | Scheuing et al. |
| 8,193,138 | B2 | 6/2012 | Nekmard |
| 8,722,609 | B2 | 5/2014 | Choczaj et al. |
| 9,103,038 | B2 | 8/2015 | Mohs et al. |

(Continued)

FOREIGN PATENT DOCUMENTS

| | | | |
|---|---|---|---|
| WO | 1995021232 | A1 | 8/1995 |
| WO | 1997045515 | A1 | 12/1997 |

(Continued)

OTHER PUBLICATIONS

Davis, G.A. et al., Household Cleaners: Environmental Evaluation and Proposed Standards for General Purpose Household Cleaners, University of Tennessee—Center for Clean Products and Clean Technologies, Jul. 1992, pp. 1-115.

*Primary Examiner* — Katie L. Hammer
(74) *Attorney, Agent, or Firm* — Adam R. Stephenson, Ltd.

(57) ABSTRACT

Implementations of cleaning compositions may include at least one of sodium lauryl sulfate, hydrochloric acid, muriatic acid, hydrobromic acid, and hydroiodic acid. Such implementations may also include benzalkonium chloride and either coco betaine or cocamidopropyl betaine. Such implementations may also include iodized salt, sodium sulfonate, and potassium nitrate.

20 Claims, 4 Drawing Sheets

(56) References Cited

U.S. PATENT DOCUMENTS

| | | | | |
|---|---|---|---|---|
| 9,365,809 | B1 * | 6/2016 | Maiuri | C11D 7/265 |
| 2008/0293612 | A1 | 11/2008 | Kellar et al. | |
| 2010/0234269 | A1 | 9/2010 | Drellinger et al. | |
| 2011/0008497 | A1 * | 1/2011 | Ghosh | A23L 27/40<br>426/74 |
| 2011/0207818 | A1 | 8/2011 | Lopes | |
| 2012/0128614 | A1 * | 5/2012 | Rieth | A61Q 5/02<br>424/70.1 |
| 2013/0146102 | A1 * | 6/2013 | Monsrud | C11D 11/0023<br>134/28 |
| 2013/0196890 | A1 | 8/2013 | Post | |
| 2015/0152359 | A1 * | 6/2015 | McCarthy | A61K 8/34<br>510/462 |
| 2017/0044466 | A1 | 2/2017 | van Buskirk et al. | |

FOREIGN PATENT DOCUMENTS

| | | | |
|---|---|---|---|
| WO | 1998049260 | A1 | 11/1998 |
| WO | 2015171092 | A2 | 11/2015 |

* cited by examiner

WATER MINERAL CLEANING SOLUTIONS AND RELATED METHODS

CROSS REFERENCE TO RELATED APPLICATIONS

This application is a continuation-in-part application of the earlier U.S. Utility Patent Application to Regalado entitled "Water Mineral Cleaning Solutions and Related Methods," application Ser. No. 16/000,106, filed on Jun. 5, 2018, now pending, which application claims the benefit of the filing date of U.S. Provisional Patent Application 62/515,167, entitled "Water Mineral Cleaning Solution and Related Methods" to Miguel Regalado which was filed on Jun. 5, 2017, the disclosures of each of which are hereby incorporated entirely herein by reference.

BACKGROUND

1. Technical Field

Aspects of this document relate generally to cleaning compositions, such as compositions for cleaning hard water stains. More specific implementations involve water mineral cleaning solutions.

2. Background

Hard water buildup may be associated with areas that are in frequent contact with water, such as swimming pools, sinks, tubs and windows. Hard water contains minerals that are left on the surface when the water evaporates, creating scale and other discoloration over time.

SUMMARY

Implementations of cleaning compositions may include at least one of sodium lauryl sulfate, hydrochloric acid, muriatic acid, hydrobromic acid, and hydroiodic acid. Such implementations may also include benzalkonium chloride and either coco betaine or cocamidopropyl betaine. Such implementations may also include iodized salt, sodium sulfonate, and potassium nitrate.

Implementations of cleaning compositions may include one, all, or any of the following:

The cleaning composition may include sodium gluconate.

The cleaning composition may include at least one of citric acid, maleic acid, oxalic acid, sulfuric acid, sulfamic acid, sodium benzoate, or glutamic acid.

The cleaning composition may include organic polymers.

The cleaning composition may include urea.

The cleaning composition may include xanthan gum.

The cleaning composition may be in an anhydrous powder.

The cleaning composition may include water, and the cleaning composition may be in a liquid form.

Implementations of cleaning compositions may include at least one of hydrochloric acid, muriatic acid, hydrobromic acid, and hydroiodic acid, may include at least one of citric acid, maleic acid, oxalic acid, sulfuric acid, sulfamic acid, sodium benzoate, and may include glutamic acid, sodium lauryl sulfate, iodized salt, benzalkonium chloride, sodium gluconate, and potassium nitrate.

Implementations of cleaning compositions may include one, all, or any of the following:

The at least one of hydrochloric acid, muriatic acid, hydrobromic acid, and hydroiodic acid may be muriatic acid.

The cleaning composition may include either coco betaine or cocamidopropyl betaine.

The cleaning composition may include xanthan gum.

The at least one of citric acid, maleic acid, oxalic acid, sulfuric acid, sulfamic acid, sodium benzoate, and glutamic acid may be citric acid.

The cleaning composition may include water, and the cleaning composition may be in a liquid form.

Implementations of cleaning solutions may include water, muriatic acid, sulfamic acid, iodized salt (iodide), citric acid, benzalkonium chloride, either coco betaine or cocamidopropyl betaine, sodium lauryl sulfate, and either xanthan gum or carboxymethyl cellulose.

Implementations of cleaning compositions may include one, all, or any of the following:

Water may make up 70-80% of the cleaning solution, by volume of the cleaning solution.

The xanthan gum may make up less than 2% of the cleaning solution, by volume of the cleaning solution.

The iodized salt may make up less than 5% of the cleaning solution, by volume of the cleaning solution.

The muriatic acid may make up less than 10% of the cleaning solution, by volume of the cleaning solution.

The cleaning solution may include sodium gluconate.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
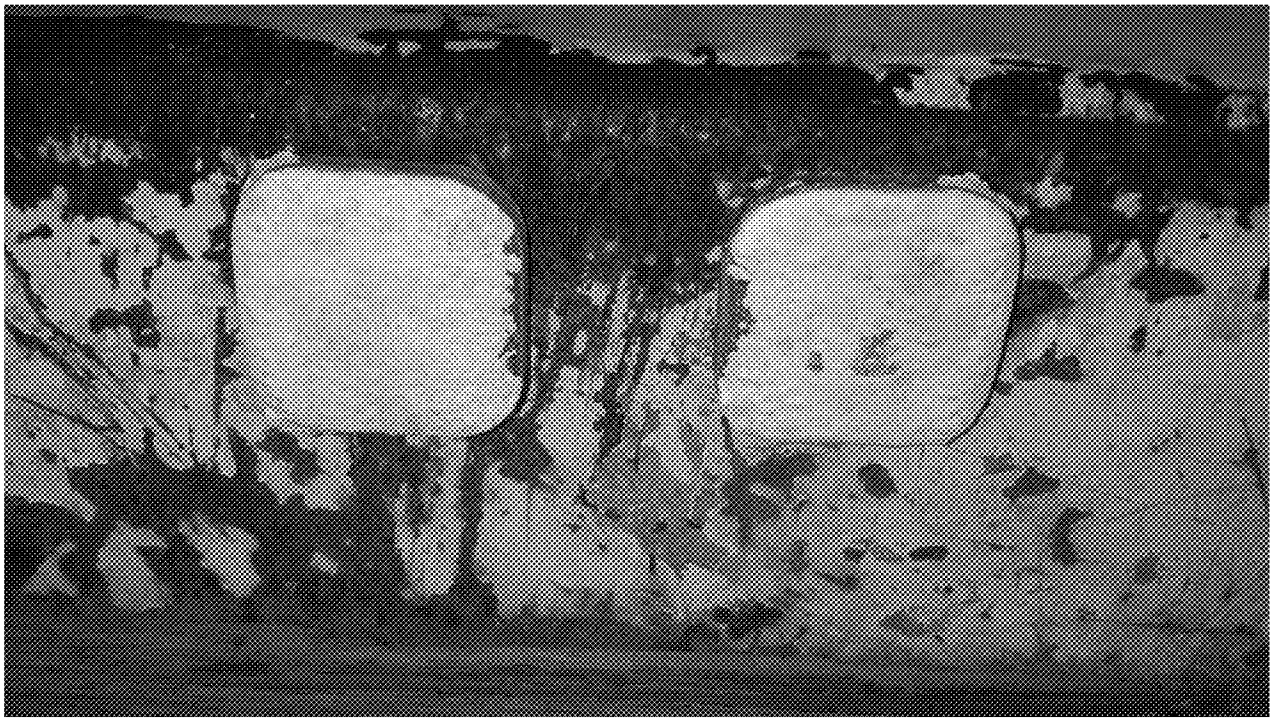
FIG. 1 is a photograph of two tiles covered with mineral deposits from hard water.

This disclosure, its aspects and implementations, are not limited to the specific components, assembly procedures or method elements disclosed herein. Many additional components, assembly procedures and/or method elements known in the art consistent with the intended cleaning compositions will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such cleaning compositions, and implementing components and methods, consistent with the intended operation and methods.

In various implementations, the cleaning compositions disclosed herein may be either an anhydrous powder, a hydrous powder, or may be a liquid solution. In implementations with a liquid solution, the solution may include water as a base. The water may be deionized water or tap water. In some implementations the cleaning solution may be in a concentrate form (anhydrous), with very little or no water included. In other implementations, the concentrate may be hydrous though still in powder form. In still other implementations the solution may not be concentrated. Where specific amounts of an element of the composition are disclosed herein, it is understood that the amounts and percentages are based on the volume of a liquid solution and not necessarily the mass of the concentrated form of the cleaning composition. While this disclosure commonly refers to cleaning solutions, it is understood by one of ordinary skill in the art that each solution/component used/added could also be in the form of an anhydrous powder.

In various implementations the cleaning solution may include an acid or a combination of acids. The acids may be, by non-limiting example, hydrochloric acid, sulfamic acid, muriatic acid, citric acid, acetic acid, or any combination thereof. In various implementations the solution includes between 1% and 10% acid by volume. In some implementations, the solution may include less than 1% acid or more than 10% acid. In particular implementations, the cleaning solution may include one or more of hydrochloric acid, muriatic acid, hydrobromic acid, and hydroiodic acid. In addition, the cleaning solution may also include, at least one of citric acid, maleic acid, oxalic acid, sulfuric acid, sulfamic acid, sodium benzoate, and glutamic acid. In still other implementations, the only acid included in the cleaning solution may be at least one of citric acid, maleic acid, oxalic acid, sulfuric acid, sulfamic acid, sodium benzoate, and glutamic acid. Such implementations may also include sodium lauryl sulfate, as disclosed later herein.

In implementations that include sulfamic acid, the solution may be about 2% by volume of a 99% by volume sulfamic acid solution.

In implementations that include hydrochloric acid, the solution may be about 3% by volume of a 49% by volume hydrochloric acid solution In implementations that include muriatic acid, the solution may be about 1% by volume of a 35% by volume muriatic acid solution.

In implementations that include citric acid, the solution may be about 1% to 7% by volume of a 99% by volume citric acid solution.

The solution may include a surfactant. In various implementations the surfactant used is sodium lauryl sulfate, however, in other implementations varying surfactants may be used. In various implementations, less than 1% by weight of a surfactant may be used, however, in other implementations the solution includes more than 1% surfactant. In specific implementations, the cleaning solution may be about 2% by volume of a 20% by volume solution of sodium lauryl sulfate.

The solution may include varying salts. The salts may be, by non-limiting example, gluconates, nitrates, and iodized salts in combination with various ions, including, by non-limiting example, sodium, potassium, lithium, or other alkali earth metals. In various implementations the nitrate is potassium nitrate and the gluconate is sodium gluconate. In various implementations, the solution includes between 1% and 2% by weight of the salts, while in other implementations the solution contains more than 2% salt or less than 1% salt by weight.

In implementations that include potassium nitrate, the solution may include about 3% by volume of a 37% by volume concentrated potassium nitrate solution.

In implementations that include sodium gluconate, the solution may include about 2% by volume of a 97% by volume concentrated sodium gluconate solution.

The solution may include urea. In implementations that include urea, the solution may include approximately 1% by weight or by volume, however, in other implementations the solution may include less or more than this.

In various implementations, the solution may include organic polymers.

The solution may include a fragrance. In various implementations, the fragrance may be limonene. Various implementations that include the limonene fragrance may include 1% by weight of solution of the fragrance. Other implementations may include more or less than this.

In various implementations of cleaning solutions, the solutions may include a thickener to increase the viscosity of the solution. In such implementations, the thickener may include, by non-limiting example, xanthan gum, carboxymethyl cellulose (CMC), any other thickener, and any combination thereof. In implementations including xanthan gum, approximately 2% by weight of the solution of xanthan gum may be included to increase the viscosity, however, other implementations may include more or less than this. In the Implementations that include carboxymethyl cellulose, the solution may include approximately 2% by weight of the solution of CMC, however, other implementations may include more or less than this. In various implementations, the solution may include about 3% by volume of a 60% by volume concentrated CMC solution.

Solutions 1-3, illustrated in the tables below, are various implementations of the cleaning solution, with the left hand columns listing the ingredient and the concentration of the solution of the ingredient and the right hand columns listing the percent by volume of the ingredient. The measurements are approximate and one of ordinary skill in the art would appreciate and understand that the following measurements are approximate. These are presented for the exemplary purposes of this disclosure.

| Solution 1 | |
|---|---|
| Water | 86% |
| Sulfamic Acid | 2% |
| Hydrochloric Acid (49% solution) | 3% |
| Sodium Lauryl Sulfate (20% solution) | 2% |
| Citric Acid (99% solution) | 7% |

| Solution 2 | |
|---|---|
| Water | Balance |
| Potassium Nitrate (37% solution) | 3% |
| Sulfamic Acid | 2% |
| Urea | 1% |
| Sodium Lauryl Sulfate (20% solution) | 2% |
| Organic Polymers | 0-5% |

| Solution 3 | |
|---|---|
| Water | 85% |
| Potassium Nitrate (37% solution) | 3% |
| Muriatic Acid (35% solution) | 1% |
| Sodium Lauryl Sulfate (20% solution) | 2% |
| Sodium Gluconate (97% solution) | 2% |
| Citric Acid | 7% |

While the solutions disclosed in tables 1-3 are effective hard water stain cleaning solutions, in various implementations iodized salt (which may be iodized table salt) may be added to any solutions disclosed herein. In such implementations it has been unexpectedly noted that the added iodized salt results in increased cleaning efficiency. Unexpectedly, the addition of about 4% by weight solution of iodized salt significantly increases the cleaning strength and effectiveness of the cleaning solutions. In various implementations, iodized salt may be included in the cleaning solutions. In such implementations, 4%, or more or less than 4% by weight of solution of the iodized salt may be added. In various implementations, the iodized salt may include various amounts of various salts of the element iodine in the form of iodide in relatively small amounts compared to the rest of the salt (NaCl, for example) or the salt may be purely salts of iodine. The iodine salts/iodide ions may react/combine with acids or other components of the cleaning solution to produce hydroiodic acid. In implementations where iodized table salt is added, there may be only trace amounts of salts of iodine in the form of iodide or iodate. In other implementations, only salts of iodine may be added. In still other implementations, iodine, in a form other than salt, may be added in order to produce the hydroiodic acid. In various implementations, all of the iodine salt may be converted to hydroiodic acid upon the addition of iodized salt to the composition, while in other implementations, only a portion of the iodine salt will be converted to hydroiodic acid upon addition to the cleaning solution.

Solution 4 is an implementation of a cleaning solution that includes iodized table salt.

| Solution 4 | |
|---|---|
| Water | 74% or 440 ml |
| Muriatic Acid (35% solution) | 7% or 18 grams |
| Sulfamic Acid (99% solution) | 2% |
| Iodized Salt | 4% or 10 grams |
| Citric Acid | 7% |
| Sodium Lauryl Sulfate (20% solution) | 2% |
| Limonene Fragrance | 1% |
| Carboxymethyl Cellulose (60% solution) | 3% |

In various implementations, the cleaning solutions/compositions disclosed herein may be limited to the components listed. In other implementations, the cleaning solutions/compositions may include more or fewer than the components listed in the specific implementations disclosed herein in various combinations.

The method of preparing the cleaning solution may include heating the water used. In various implementations, the water is heated between 80-90 degrees Celsius. The method may include mixing the remaining ingredients in the heated water and dissolving the ingredients in the water. The method may further include cooling the solution back to room temperature before applying it to a surface to be cleaned.

Referring specifically to solution 4 outlined above, the solution may be prepared by adding the sulfamic acid solution, the citric acid solution, and the iodized salt to 200 ml of warm water. The carboxymethyl solution may be added to a separate 240 ml of water. In various implementations, after the acids, salt, and carboxymethyl have dissolved, the two solution may be combined and the remaining ingredients may be added. In other implementations, all the ingredients are added to 440 ml of water. The water may be hot, warm, cold, or room temperature. One of ordinary skill in the art understands that the methods disclosed herein may be scaled up or down to produce more or less of the cleaning solution.

The solution may be used to remove hard water stains from, by non-limiting example, aluminum, granite, stainless steel, metal, tile, rock, stone, concrete, chrome, or any combination thereof. In various implementations the cleaning solution may be applied to the surface with the hard water stains. In various implementations the solution may be applied to soak the surface. In such implementations, the solution may be allowed to soak the surface for 20 minutes, while in other implementations it may be allowed to soak the surface longer or shorter than 20 minutes. In various implementations the solution and the hard water stains may then be wiped, scrubbed, or sprayed away.

Figure 2:
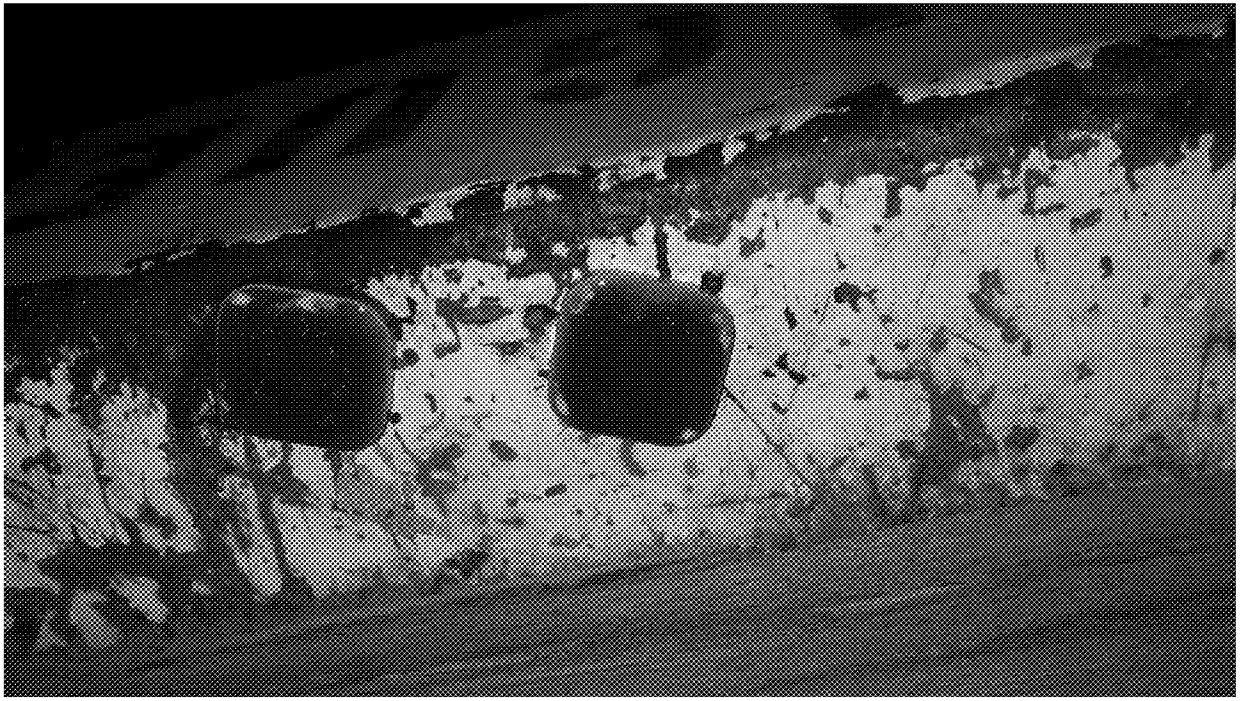
FIG. 2 is a photograph of the two tiles of FIG. 1 after being treated with an implementation of one of the cleaning solutions disclosed herein.
Figure 3:
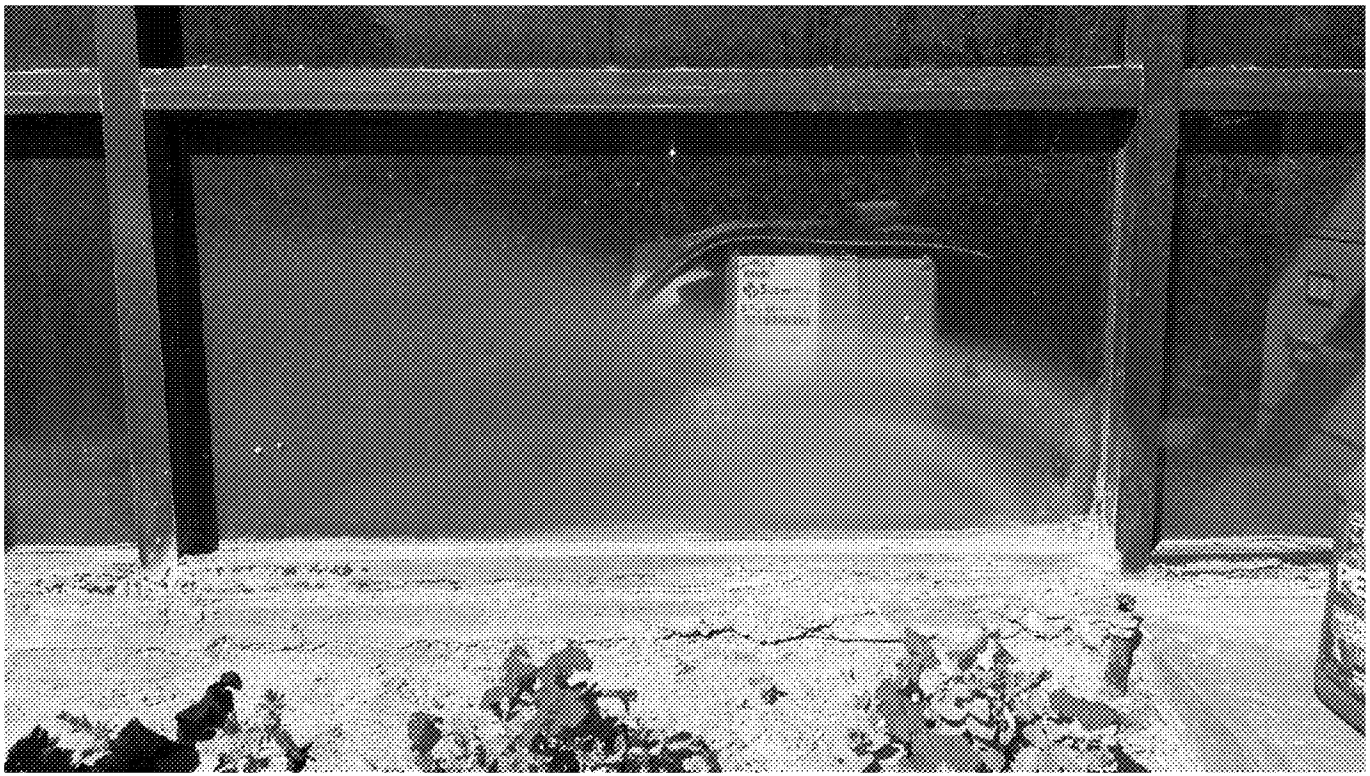
FIG. 3 is a photograph of a window having hard water stains from overspray from sprinklers.
Figure 4:
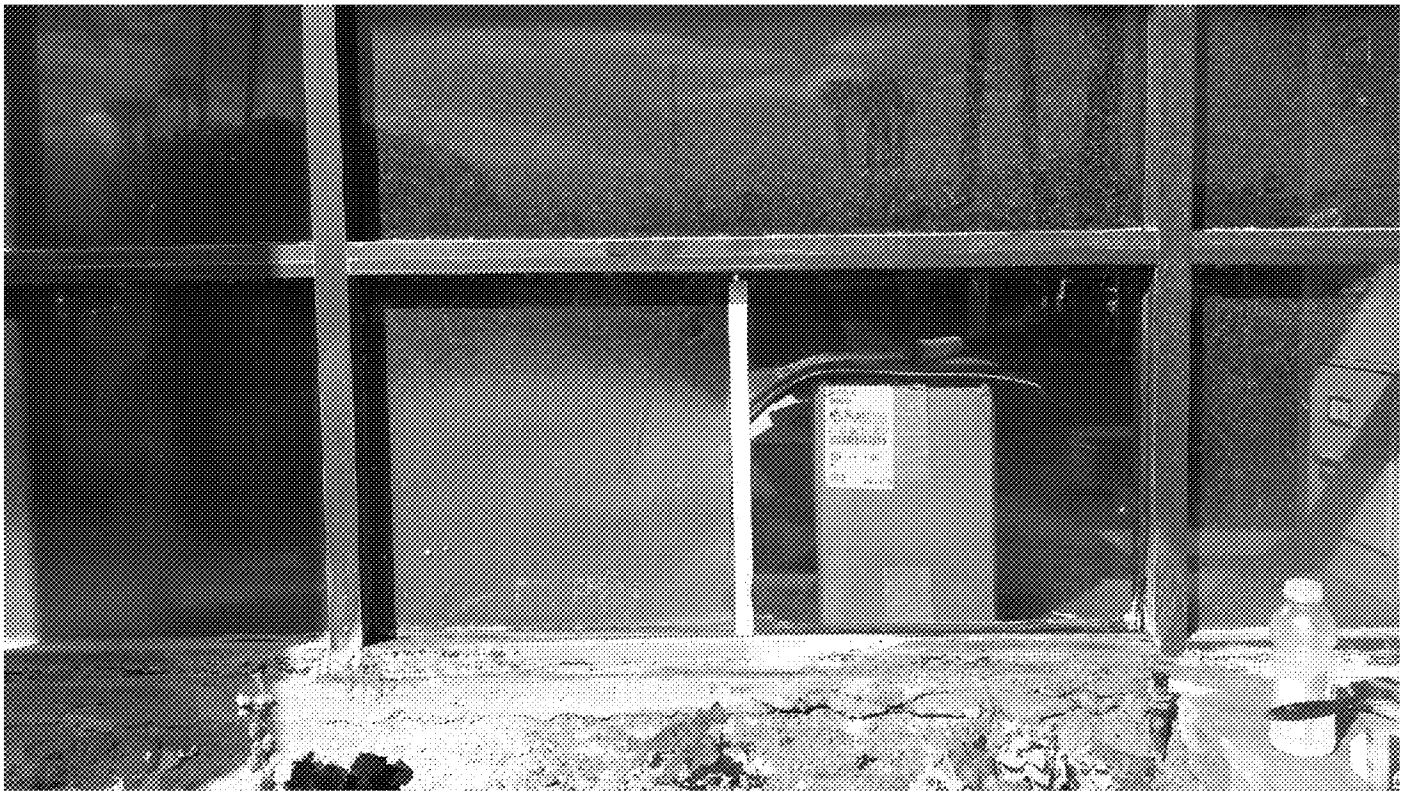
FIG. 4 is a photograph of the window of FIG. 3 after being treated with an implementation of one of the cleaning solutions disclosed herein.

The solution may be applied to a variety of surfaces, including, by non-limiting example, swimming pools, bath tubs, sinks, toilets, showers, floors, windows, tires, wheels, swimming pool decks, concrete surfaces, and any other surface type. Referring to FIG. 1, a photograph of two tiles covered in mineral deposits is illustrated. Referring to FIG. 2, a photograph of the two tiles of FIG. 1 after being treated with an implementation of one of the cleaning solutions disclosed herein is illustrated. As is clearly visible, the cleaning solutions disclosed herein are capable of removing significant amounts of hard water buildup/mineral deposits after a single treatment. Similarly, referring to FIG. 3, a photograph of a window having hard water stains is illustrated. Referring to FIG. 4, a photograph of the window of FIG. 3 after being treated with an implementations of one of the cleaning solutions disclosed herein is shown. A piece of tape divides the middle of the window of FIG. 4, with the right side of the window being treated by a cleaning solution and the left side being left untreated. As is clearly visible between FIGS. 3-4, the cleaning solutions disclosed herein efficiently removed the hard water stains/buildup.

In various implementations, benzalkonium chloride may be included in any of the solutions or cleaning compositions disclosed herein. Further, any of the methods disclosed herein may include adding benzalkonium chloride to the solutions or cleaning compositions. As used herein, benzalkonium chloride has the same meaning as chloride of benzalkonium. In particular implementations, any of the compositions or solutions disclosed herein may include 10 milligrams of benzalkonium chloride, though other compositions and/or solutions may include more or less than 10 milligrams of benzalkonium chloride. In implementations including benzalkonium chloride, the benzalkonium chloride may serve as a disinfecting agent in the composition and/or solution.

In various implementations, either coco betaine, cocamidopropyl betaine, or a combination thereof, may be included in any of the solutions or cleaning compositions disclosed herein. Further, any of the methods disclosed herein may include adding either coco betaine, cocamidopropyl betaine, or a combination thereof to the solutions and/or cleaning compositions. In particular implementations, any of the compositions or solutions disclosed herein may include 15 milligrams of either coco betaine, cocamidopropyl betaine, or a combination thereof, though other compositions and/or solutions may include more or less than 15 milligrams of either coco betaine, cocamidopropyl betaine, or a combination thereof. In implementations including either coco betaine, cocamidopropyl betaine, or a combination thereof, the coco betaine, cocamidopropyl betaine, or combination thereof may improve the performance of the cleaning composition and/or solution.

In places where the description above refers to particular implementations of cleaning compositions and implementing components, sub-components, methods and sub-methods, it should be readily apparent that a number of modifications may be made without departing from the spirit thereof and that these implementations, implementing components, sub-components, methods and sub-methods may be applied to other cleaning compositions.

What is claimed is:

1. A cleaning composition comprising:

at least one of sodium lauryl sulfate, hydrochloric acid, muriatic acid, hydrobromic acid, or hydroiodic acid;

benzalkonium chloride;

one of coco betaine or cocamidopropyl betaine;

iodized salt;

sodium sulfonate; and potassium nitrate.

2. The cleaning composition of claim 1, further comprising sodium gluconate.

3. The cleaning composition of claim 1, further comprising at least one of citric acid, maleic acid, oxalic acid, sulfuric acid, sulfamic acid, sodium benzoate, or glutamic acid.

4. The cleaning composition of claim 1, further comprising organic polymers.

5. The cleaning composition of claim 1, further comprising urea.

6. The cleaning composition of claim 1, further comprising xanthan gum.

7. The cleaning composition of claim 1, wherein the cleaning composition is in an anhydrous powder.

8. The cleaning composition of claim 1 further comprising water, wherein the cleaning composition is in a liquid form.

9. A cleaning composition comprising:

at least one of hydrochloric acid, muriatic acid, hydrobromic acid, and hydroiodic acid;

at least one of citric acid, maleic acid, oxalic acid, sulfuric acid, sulfamic acid, sodium benzoate, and glutamic acid;

sodium lauryl sulfate;

iodized salt;

benzalkonium chloride;

sodium gluconate; and potassium nitrate.

10. The cleaning composition of claim 9, wherein the at least one of hydrochloric acid, muriatic acid, hydrobromic acid, and hydroiodic acid is muriatic acid.

11. The cleaning composition of claim 9, further comprising one of coco betaine or cocamidopropyl betaine.

12. The cleaning composition of claim 9, further comprising xanthan gum.

13. The cleaning composition of claim 9, wherein the at least one of citric acid, maleic acid, oxalic acid, sulfuric acid, sulfamic acid, sodium benzoate, and glutamic acid is citric acid.

14. The cleaning composition of claim 9 further comprising water, wherein the cleaning composition is in a liquid form.

15. A cleaning solution comprising:

water;

muriatic acid;

sulfamic acid;

iodized salt;

citric acid;

benzalkonium chloride;

one of coco betaine or cocamidopropyl betaine;

sodium lauryl sulfate; and one of xanthan gum and carboxymethyl cellulose.

16. The cleaning solution of claim 15, wherein water makes up 70-80% of the cleaning solution, by volume of the cleaning solution.

17. The cleaning solution of claim 15, wherein the xanthan gum makes up less than 2% of the cleaning solution, by volume of the cleaning solution.

18. The cleaning solution of claim 15, wherein the iodized salt makes up less than 5% of the cleaning solution, by volume of the cleaning solution.

19. The cleaning solution of claim 15, wherein the muriatic acid makes up less than 10% of the cleaning solution, by volume of the cleaning solution.

20. The cleaning solution of claim 15 further comprising sodium gluconate.

* * * * *